US005546167A

United States Patent [19]

Ogata et al.

[11] Patent Number: 5,546,167

[45] Date of Patent: Aug. 13, 1996

[54] CHARGING DEVICE, PROCESS CARTRIDGE AND IMAGE FORMING APPARATUS

[75] Inventors: Hiroaki Ogata, Kawasaki; Hiroki Kisu, Fujisawa; Michihito Yamazaki, Tokyo; Erika Asano, Utsunomiya, all of Japan

[73] Assignee: Canon Kabushiki Kaisha, Tokyo, Japan

[21] Appl. No.: 265,273

[22] Filed: Jul. 1, 1994

[30] Foreign Application Priority Data

Jul. 7, 1993 [JP] Japan ..... 5-193098

[51] Int. Cl.[6] ..... G03G 15/02

[52] U.S. Cl. ..... 355/219; 355/200; 361/225

[58] Field of Search ..... 355/219, 271, 355/274, 276, 277, 200, 210; 361/225

[56] References Cited

U.S. PATENT DOCUMENTS

| | | | |
|---|---|---|---|
| 4,171,157 | 10/1979 | Suzuki | 355/274 X |
| 4,309,803 | 1/1982 | Blaszak | 355/219 X |
| 4,380,384 | 4/1983 | Ueno et al. | 355/219 |
| 4,494,857 | 1/1985 | Ueno et al. | 355/219 X |
| 4,727,453 | 2/1988 | Ewing | 361/225 |
| 5,126,913 | 6/1992 | Araya et al. | 361/225 |
| 5,144,368 | 9/1992 | Ohzeki et al. | 355/219 |
| 5,150,157 | 9/1992 | Yamaki | 355/219 |
| 5,177,534 | 1/1993 | Kisu et al. | 355/219 |
| 5,192,974 | 3/1993 | Ikegawa et al. | 355/219 |
| 5,243,387 | 9/1993 | Ikegawa | 355/219 |

FOREIGN PATENT DOCUMENTS 63-149669 6/1988 Japan .

*Primary Examiner*—Sandra L. Brase

*Attorney, Agent, or Firm*—Fitzpatrick, Cella, Harper & Scinto

[57] ABSTRACT

A charging member has a charging surface having a concave surface that is positioned on the opposite side of a line H than a side at which an object to be charged is disposed, wherein H is a line that (i) is tangent to a surface of the object to be charged at a point at a downstream end of a contact section or a closest-proximity section between the charging surface and the object to be charged, and (ii) extends downstream from the point of tangency, where the downstream direction is determined with respect to a direction of movement of the object to be charged. By this arrangement, a charging region can be enlarged and periodic fluctuations in a surface potential of the object to be charged can be mitigated.

14 Claims, 13 Drawing Sheets

CHARGING DEVICE, PROCESS CARTRIDGE AND IMAGE FORMING APPARATUS

BACKGROUND OF THE INVENTION

1. Field of the Invention

The present invention relates to a charging device having a charging member held in contact with or in close proximity to an object to be charged so as to charge the same. The present invention also relates to a process cartridge and an image forming apparatus which are equipped with such a charging member.

2. Description of the Related Art

In image forming apparatus, such as electrophotographic apparatus (including copying machines and laser beam printers) or electrostatic recording apparatus, a corona discharge device, which effects corona discharge by applying high voltage to a wire, has widely been used as the means for performing the charging process (which also includes charge removal) on the object to be charged, which object consists, for example, of an image carrying member, such as a photosensitive or dielectric member. The corona discharge device adopts a non-contact type charging system in which the object surface to be charged is exposed to the corona generated by the corona charger so as to be charged thereby.

Currently, the use of contact-type charging means (for contact charging) is increasing. In contact charging, a voltage is applied to a charging member (a conductive member) of a roller-type, blade-type, etc., which is held in contact with or in close proximity to the surface of the object to be charged so as to charge the same.

It is not absolutely necessary for the charging member to be in contact with the surface of the object to be charged. A non-contact state in which the charging member and the object to be charged are in close proximity to each other will suffice as long as the requisite discharge region, which is determined by an inter-gap voltage and a correction Paschen curve, is reliably ensured between the charging member and the surface of the object to be charged. This kind of non-contact charging will also be included in the category of "contact charging" described below.

A charging device of the contact type has the following advantages over the corona discharge device, which is of the non-contact type: the requisite application voltage for obtaining a desired electric potential on the surface of the object to be charged is relatively small; the amount of ozone generated during the charging process is so small as to eliminate the need for an ozone removal filter, thereby simplifying the structure of the gas discharge system of the device; it is maintenance-free; it has a simple structure; etc.

In view of this, contact-type charging devices are attracting attention as a substitute for the corona discharge device to be used as the means for performing charging process on the object to be charged, which consists of a photosensitive member or the like, in image forming apparatus like electrophotographic apparatus or electrostatic recording apparatus, and have actually been put into practical use as such charging means.

In contact charging, the voltage to be applied to the charging member may be a DC voltage (a DC application system) or an oscillating voltage, which is a voltage whose value periodically fluctuates with time (an AC application system).

Regarding the AC application system, the present applicant has made a proposal in Japanese Patent Laid-Open No. 63-149669, etc., according to which charging is executed by applying an oscillating voltage and, in particular, an oscillating voltage exhibiting an inter-peak voltage that is not smaller than double the charging-start voltage, which is a DC voltage applied to the object to be charged to start the charging thereof. This system has proved effective, for it is capable of performing a uniform charging process (including charge removal).

The oscillating voltage is a voltage comprising an oscillating voltage component (hereinafter referred to as the "AC component"), or a combination of such an AC component and a DC voltage component (a voltage corresponding to the target charging potential, hereinafter referred to as the "DC component") superimposed one upon the other. Appropriate examples of the AC component waveform include a sinusoidal wave, a rectangular wave and a triangular wave. A rectangular-wave voltage formed by periodically turning ON/OFF a DC power source will also serve the purpose.

FIG. 11 is a schematic diagram showing an example of the construction of an image forming apparatus employing a contact-type charging device of the AC application system as the charging means. The image forming apparatus of this example consists of a laser beam printer utilizing the electrophotographic process.

A photosensitive drum 100 has a photosensitive layer 101 and a base 102, and rotates in the direction indicated by an arrow A. A charging roller 200, which serves as the charging member, has a core 201 and a conductive rubber 202 and is pressed against the drum 100 by a spring 3. AC and DC voltages are applied to the charging roller 200 from a power source 4. The charging surface of the charging roller 200 is on the opposite side of the drum with respect to a plane which contains a tangent H passing through a point o on the surface of the drum 100 where it is in contact with the charging roller 200. The drum 100, charged by the charging roller 200, is subjected to image exposure that is effected by a laser beam, whereby an electrostatic latent image is formed on the drum. Then, a toner image is formed on the drum by a development sleeve 6. The toner image on the drum 100 is transferred onto a recording paper 7 by a transfer roller 8. After the transfer, the toner remaining on the drum 100 is removed therefrom by a cleaner 9.

The image forming apparatus described above, which uses a contact-type charging device as the means for charging the object to be charged (the image carrying member), has the following problems:

To obtain a stable surface potential, an oscillating voltage is used in the AC application system as the voltage to be applied to the charging member 200. In the surface potential thus obtained, positive and negative voltage components alternately repeat themselves to be concentrated into a DC voltage Vdc, resulting in fine periodic fluctuations appearing in the surface potential.

FIG. 12 is a graph showing such fluctuations in surface potential. In the diagram, the horizontal axis indicates the displacement of the surface of the photosensitive drum 100, which serves as the object to be charged. Here, the displacement of the drum surface, which occurs with the rotation of the drum, is recorded starting from the point o, at which the drum 100 is in contact with the charging roller 200. The vertical axis of the diagram indicates the surface potential. In FIG. 12, an area indicated by symbol B represents a charging region, corresponding to the region B in FIG. 11, where charging is actually performed. The potential difference in the fluctuations ranges from several tens of V to one hundred and several tens of V, and the period of the potential fluctuations depends upon the frequency f of the power source 4 and the process speed.

FIG. 13 is a diagram representing the surface of the recording paper 7, on which the above fluctuations in potential are schematically visualized, as indicated at 7*a*. Assuming that a special pattern having a specific period in the direction in which the recording paper is fed, e.g., a lateral-striped pattern as indicated at 7*b*, is output onto the recording paper 7, an interference pattern 7*c* will be generated in the image if the interval of the stripes is close to that of the potential fluctuations on the drum surface.

Due to the restrictions in the precision of the parts, a variation of not smaller than 10% from a predetermined value is inevitable in the AC component frequency of the power source 4. Thus, depending upon the power source, the frequency may be close to the spatial frequency of the stripes, resulting in the generation of a serious interference pattern.

To cope with the problem of such an interference pattern, the present applicant has proposed a system according to which the AC component frequency of the power source to be applied to the charging member is increased in accordance with the process speed. However, the current high process speed, which is a result of the recent increase in the speed of image processing apparatus, has led to another problem that the so-called "charging noise", which is due to a primary power source frequency, increases as this primary frequency increases.

SUMMARY OF THE INVENTION

It is an object of the present invention to provide a charging device, a process cartridge and an image forming apparatus in which are capable of preventing the generation of interference patterns.

Another object of the present invention is to provide a charging device, a process cartridge and an image forming apparatus which are capable of mitigating the charging noise.

Other objects and features of the present invention will become more apparent from the following detailed description when the same is read with reference to the accompanying drawings.

DETAILED DESCRIPTION OF THE PREFERRED EMBODIMENTS

Embodiments of the present invention will now be described with reference to the drawings.

Figure 1:
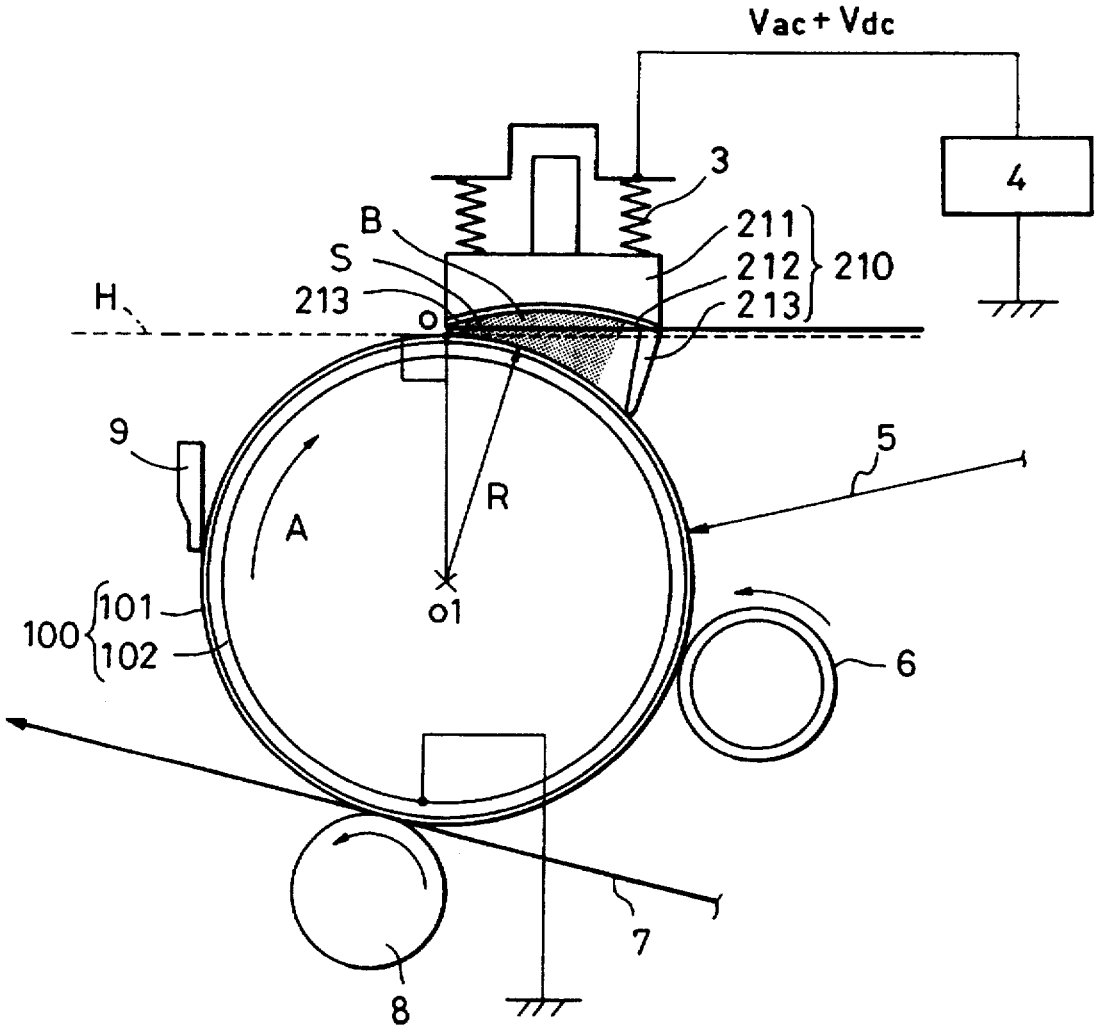
FIG. 1 is a schematic diagram showing an apparatus according to a first embodiment of the present invention.
Figure 2:
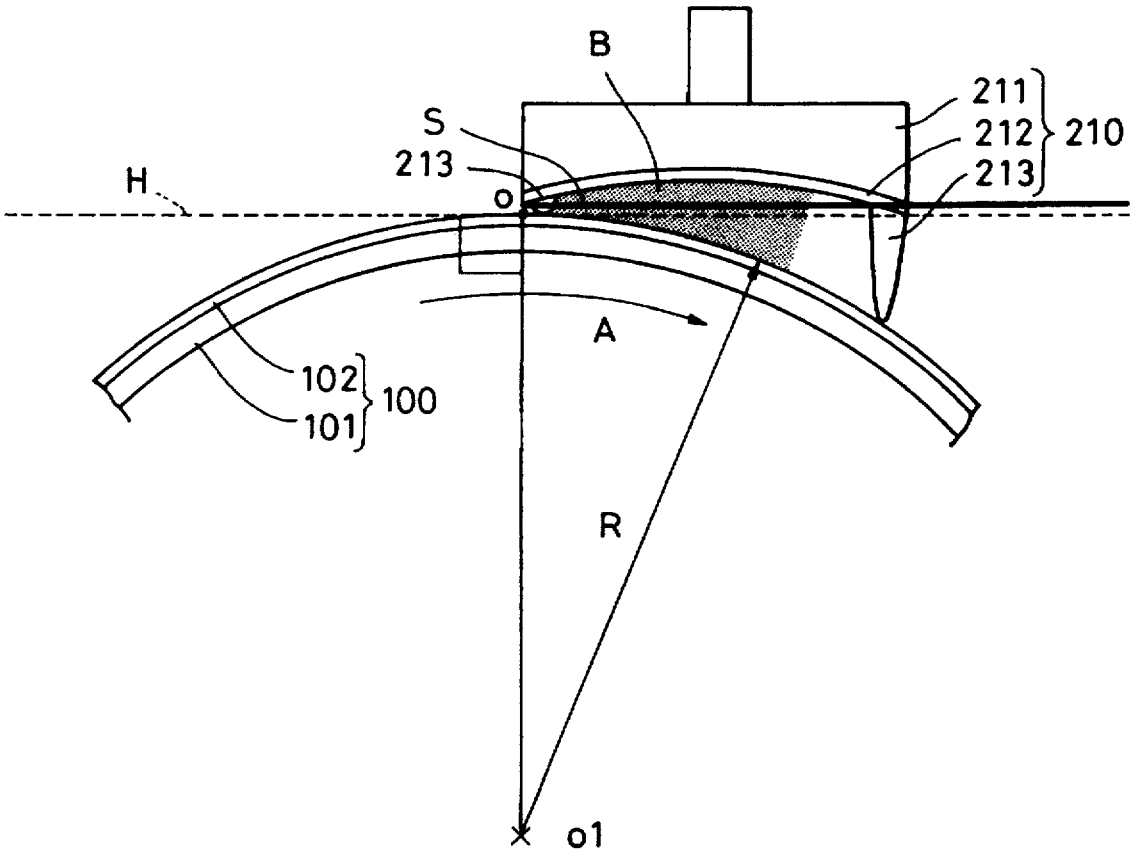
FIG. 2 is an enlarged view of the apparatus, concentrating on the charging member thereof.

FIG. 1 is a schematic diagram showing an image forming apparatus according to the first embodiment of the present invention; and FIG. 2 is an enlarged view of the apparatus, concentrating on the charging member thereof.

The image forming apparatus of this embodiment is a laser beam printer utilizing the electrophotographic process. The apparatus uses a non-contact type charging device as the means for charging a photosensitive drum 1 serving as the object to be charged (the image carrying member).

Numeral 100 indicates a drum-shaped electrophotographic photosensitive member (hereinafter referred to as the "photosensitive drum"), which consists of a drum base 102 formed of aluminum, and an OPC (organic photoconductive) member 101 formed on the outer peripheral surface of the drum base 102 and serving as the photosensitive layer. The photosensitive drum 100 has an outer diameter of 30 mm (2×R), and is rotated clockwise in the direction indicated by an arrow A at a predetermined peripheral velocity (process speed).

Numeral 4 indicates a power source for applying a voltage to a charging member 210. The power source 4 applies a superimposed voltage (Vac+Vdc), which is composed of an AC component Vac and a DC component Vdc and which has an inter-peak voltage Vpp that is not smaller than double the charging start voltage for the photosensitive drum 100, to the charging member 210, whereby a rotating outer peripheral surface of photosensitive drum 100 is uniformly contact-charged by the AC application system. In the drawing, symbol B indicates a region where charging is actually effected.

An oscillating voltage (which is a voltage whose value periodically fluctuates with time) is applied between the charging member 210 and the photosensitive drum 100. Examples of the waveform of the oscillating voltage include a sinusoidal wave, a rectangular wave and a triangular wave. The oscillating voltage may also be a rectangular-wave voltage which is formed by periodically turning ON/OFF a DC power source. When forming an electrostatic latent image, such a rectangular-wave voltage has a waveform composed of AC and DC voltages that are superimposed one upon the other. Here, the term "charging" also means the removal of charge from the object to be charged. When charge removal is performed, it is desirable for the oscillating voltage to have an AC-voltage waveform. To prevent spot-like inconsistencies in charging on the photosensitive drum 100, it is desirable that the inter-peak voltage of the oscillating voltage be not smaller than double the charging start voltage for the photosensitive drum (i.e., the DC voltage applied between the photosensitive drum 100 and the charging member 210 when the charging of the photosensitive drum is started). This charging start voltage varies in accordance with changes in the impedance of the photosensitive drum, the charging member, etc.

A time-series electric digital pixel signal representing the target image (printing) information is input to a laser scanner (not Shown) from a host apparatus (not shown), such as a computer, a word processor or an image reading apparatus, and a laser beam 5, which is image-modulated with a constant printing density Ddpi in accordance with the input pixel signal, is output from the laser scanner, which is controlled by a controller, to perform line scanning (main scanning exposure along the dimension of the drum generatrix) on the surface of the rotating photosensitive drum 100 to be charged, whereby the writing of the target image information is effected to form a latent image corresponding to the image information on the surface of the rotating photosensitive drum 100.

The latent image is visualized as a toner image through reversal development by the development sleeve 6. The toner image thus obtained is successively transferred to the recording paper (the transfer material) 7, which is fed with a predetermined timing from a paper feed section (not shown) to a press-contact nipping section (the transfer position) between the photosensitive drum 100 and the transfer roller 8. 5 The recording paper 7, to which the toner image has been transferred, is separated from the surface of the photosensitive drum 100 and conveyed to a fixing device (not shown), where the toner image is fixed to the recording paper 7, which is then output with an image formed thereon. Further, after the transfer material is separated from it, the surface of the rotating photosensitive drum 100 is subjected to a cleaning process which is conducted by the cleaning blade 9 of the cleaner unit to remove the remaining toner or other substance, whereby the surface of the photosensitive drum is made ready for another image formation process.

The charging member 210 will be described in more detail.

First Embodiment

The charging member 210 has a charging surface (i.e., the surface facing the photosensitive drum 100) which is formed as a concave surface having a radius of curvature of 19 mm. The charging member 210 consists of an electrode plate 211 formed of metal, conductive plastic, conductive rubber or the like, and a high-resistance layer 212 formed on the charging surface.

The high-resistance layer 212 is provided for the purpose of preventing leakage from the charging member 210 toward any surface defect like a pin hole on the photosensitive drum 100. The generation of leakage can also be eliminated by forming the electrode plate 211 of a material having a medium resistance (approximately $10^5$ to $10^{10}$ Ωcm) (e.g., nylon resin).

The charging member 210 is held by a spacer 213 in such a way that the gap between the photosensitive drum 100 and the charging member 210 is larger on the downstream side than on the upstream side with respect to the direction of rotation of the photosensitive drum 100.

The charging surface of the charging member 210 is on the opposite side of the photosensitive drum 100 with respect to a plane S containing a segment which is parallel to the tangent H passing through the closest-proximity section o on the surface of the photosensitive drum and which extends from the downstream end of the closest-proximity section o. In the case where the charging member 210 is in contact with the photosensitive drum 100, the charging surface is on the opposite side than the drum 100 with respect to the tangent H extending from the downstream end of the contact section between the charging member 210 and the drum 100.

In this embodiment, the distance between the charging member and the photosensitive drum is set at 100 μm on the upstream side and at 700 μm on the downstream side, with respect to the direction of rotation A of the photosensitive drum.

A bias voltage (Vdc+Vac), composed of a DC voltage and an AC voltage of a frequency f superimposed thereon, is applied from the the power source 4 to the charging member 210 through the pressurizing springs 3, thereby charging the peripheral surface of the rotating photosensitive drum 100 to a predetermined electric potential. Symbol B indicates a charging region where charging is actually effected.

As described above, the charging member 210 whose charging surface is formed as a concave surface is arranged in such a way that the charging region B is relatively narrow on the upstream side, and relatively wide on the downstream side, with respect to the direction of rotation of the photosensitive drum, thereby mitigating the periodic fluctuations in surface potential of the charged photosensitive drum 1 as compared to those in the prior art.

Figure 3:
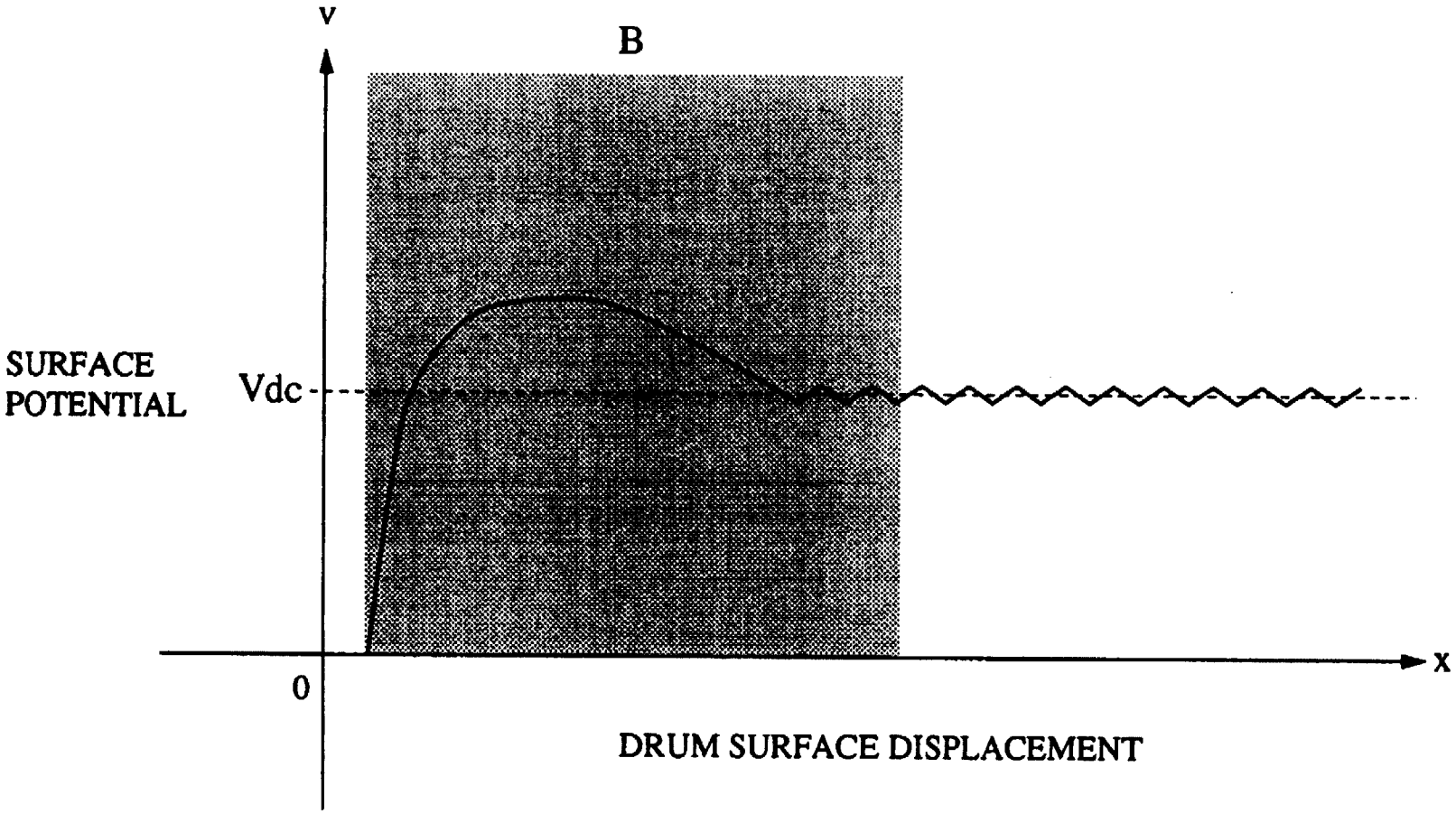
FIG. 3 is a graph showing fluctuations in surface potential.
Figure 12:
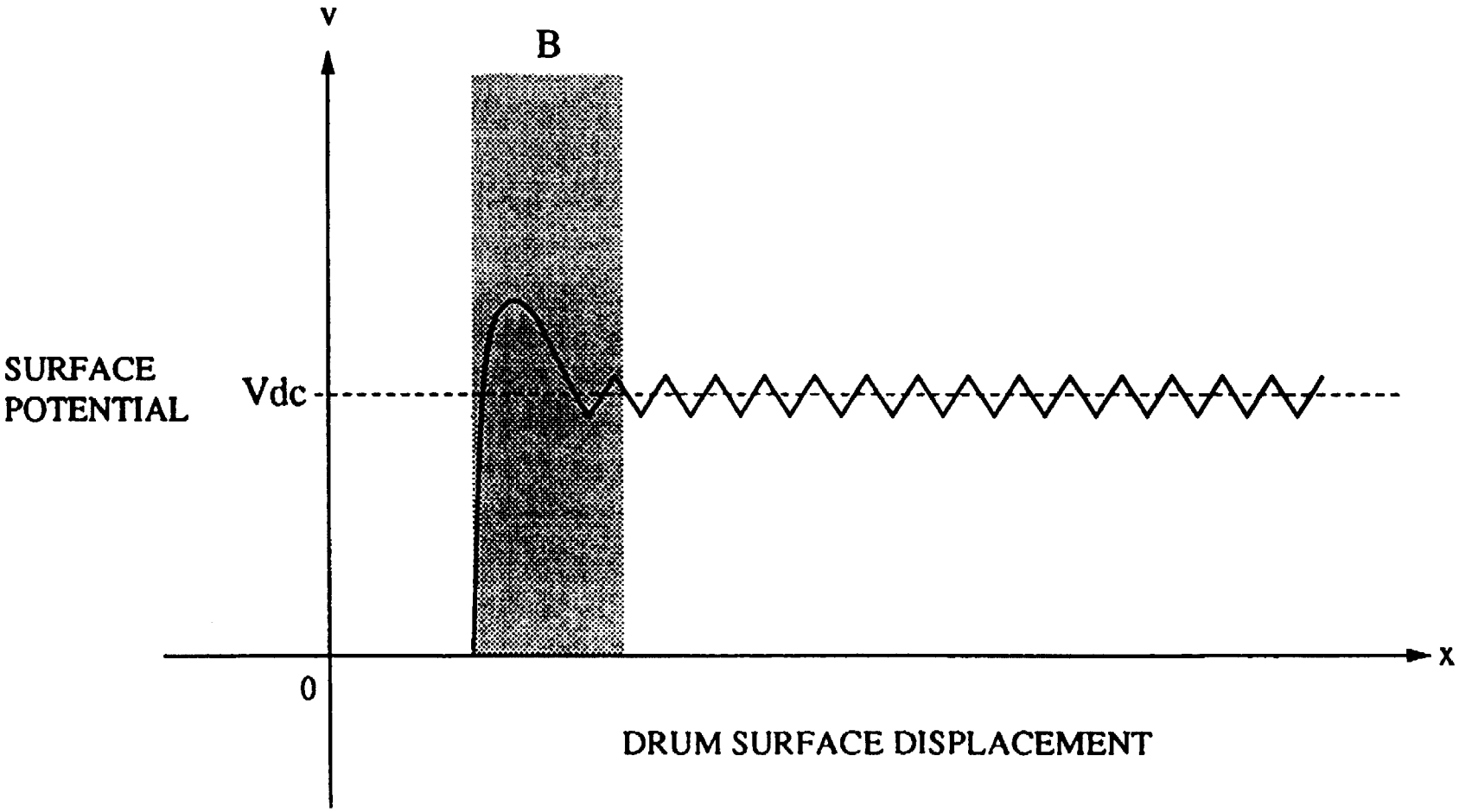
FIG. 12 PRIOR ART
FIG. 12 is a graph showing fluctuations in surface potential (when the charging member consists of a charging roller)
Figure 13:
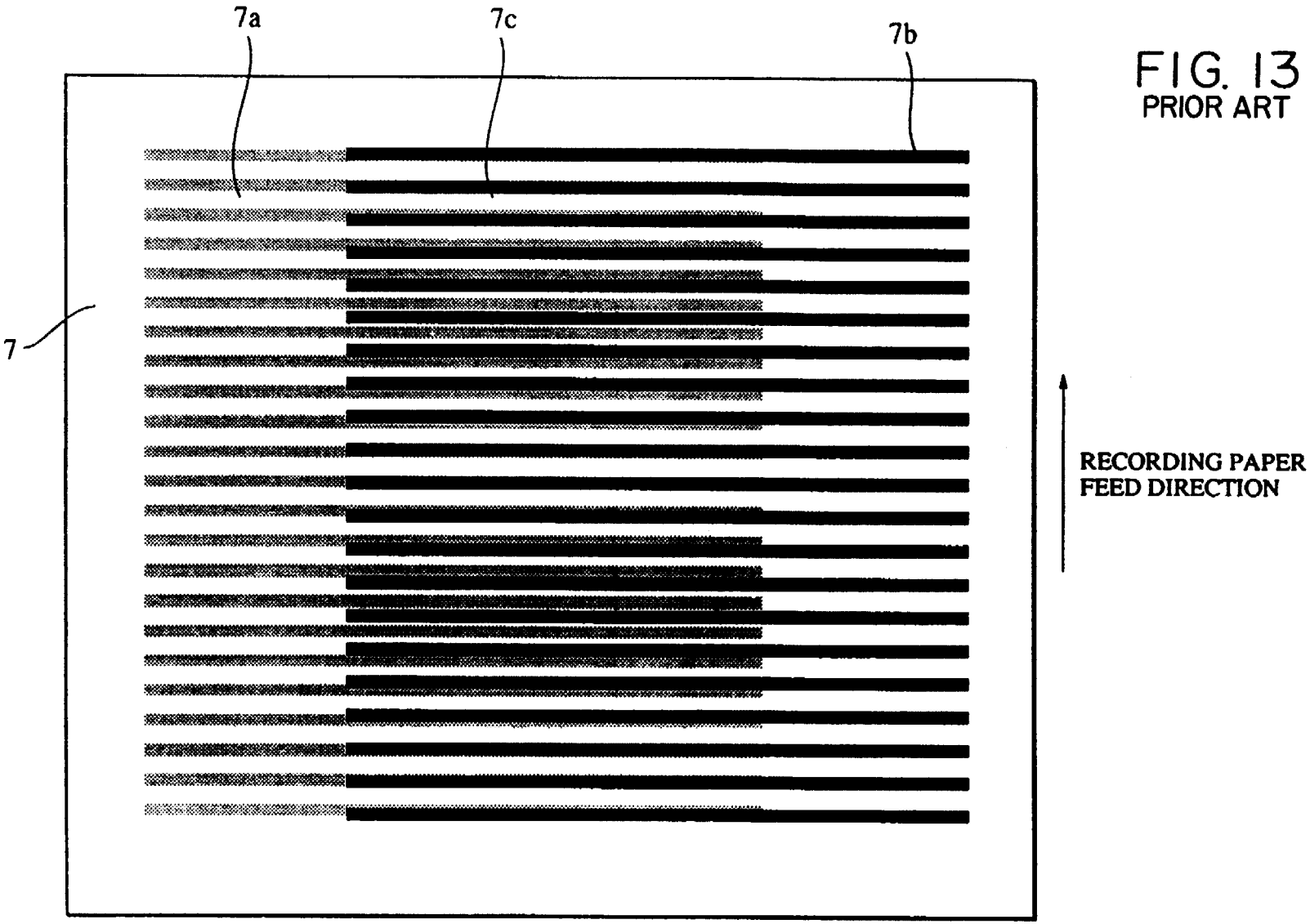
FIG. 13 PRIOR ART
FIG. 13 is a schematic diagram showing an interference pattern generated in an output image.

FIG. 3 shows the state of the surface potential on the drum surface. As in the case of the above-described prior-art example (where a charging roller is used), shown in FIG. 12, the horizontal axis in FIG. 3 indicates the displacement of the drum surface as from the upstream end o of the charging member 210 with respect the direction of rotation of the photosensitive drum, and the vertical axis indicates the surface potential. In FIG. 3, symbol B indicates the charging region, where charging is actually effected.

Figure 4:
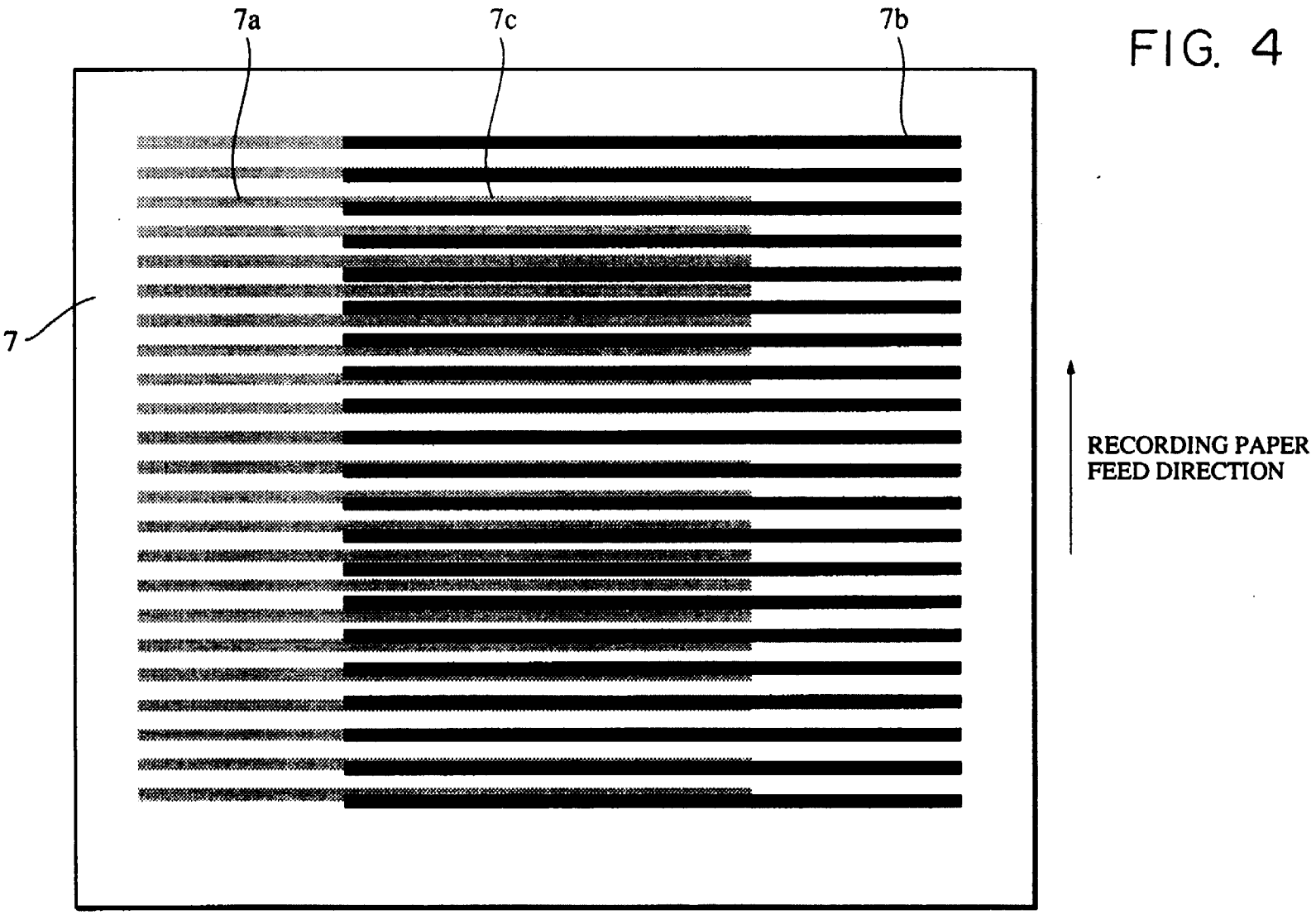
FIG. 4 is a schematic diagram showing an interference pattern generated in an output image.

In this embodiment, the potential difference in the fluctuations in surface potential was ten and several V. This is due to the fact that the charging surface of the charging member 210 is formed as a concave surface and that the charging member 210 is arranged in such a way that the charging region B is relatively narrow on the upstream side, and relatively wide on the downstream side, with respect to the direction of rotation of the photosensitive drum, thereby mitigating the fluctuations in surface potential in the charging region and enlarging the charging region. Due to this arrangement, the interference pattern 7*c* is made less conspicuous, as shown in the schematic diagram of FIG. 4, even when the image is output under the same conditions as in the prior-art example.

As described above, the above construction helps to mitigate the periodic fluctuations of the surface potential, whereby it is possible to reduce the interference pattern to a negligible level.

Further, the fact that the periodic fluctuations in surface potential can be mitigated signifies that the application frequency can be reduced while maintaining the process speed at the same level, whereby it is also possible to reduce the charging noise.

The present inventors installed an apparatus having a system as shown in FIG. 1 in an anechoic room, and measured the noise under the above conditions in accordance with ISO 7779, Section 6. The measurement results showed that the noise of the apparatus of this invention was as small as 33 dB, whereas the noise in the prior-art apparatus is approximately 55 dB. Further, the interference pattern was totally inconspicuous.

Further, by holding the charging member 210 out of contact with the photosensitive drum 100 as in this embodiment, the fusion, scraping, drum contamination, etc., caused by the rubbing of the charging member against the drum 100, can be prevented more effectively as compared to the case where the the charging member 210 is held in contact with the drum 100.

While this embodiment, in which the problems of moir é, charging noise, etc. are overcome, has been described as applied to a charging device of the type in which an AC voltage is applied (the AC application system), the charging member of this embodiment is also applicable to a charging device of the type in which only a DC voltage is applied (the DC application system) since the charging member of this invention, having the above-described configuration, provides various merits, such as a wide charging region and a low cost.

Figure 5:
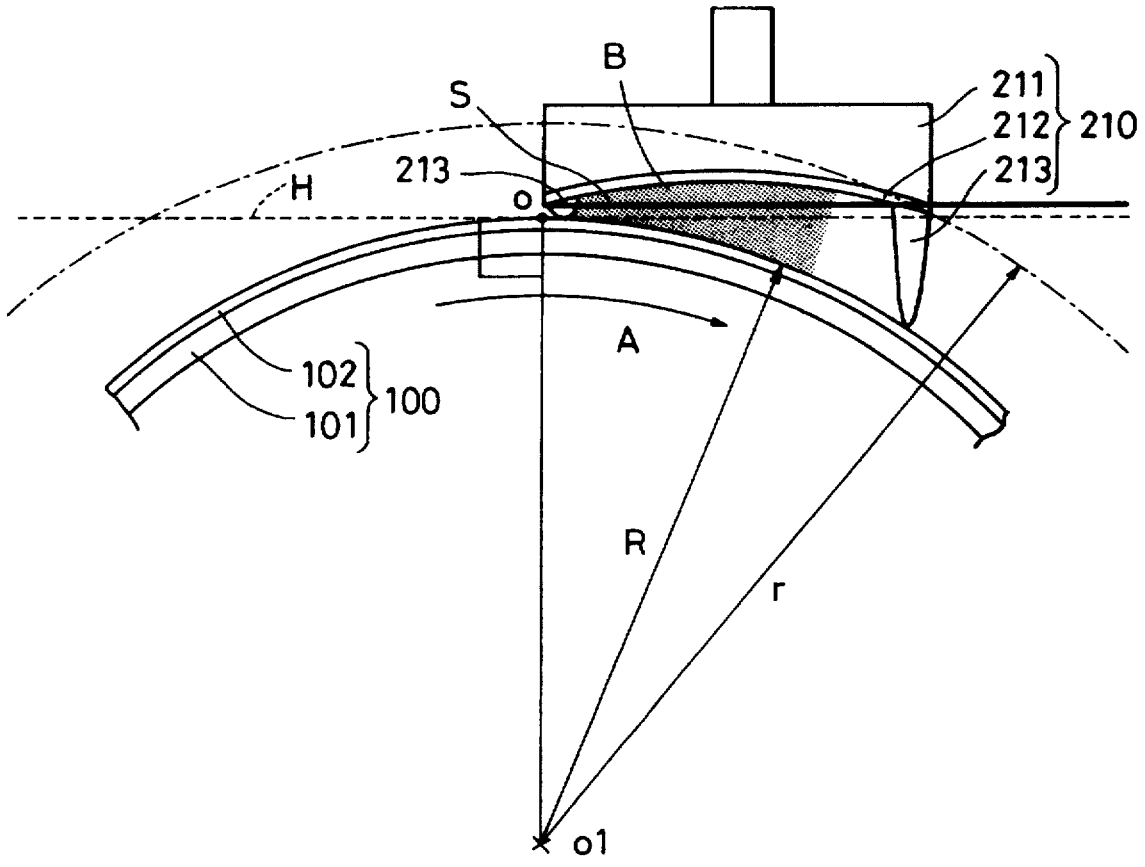
FIG. 5 is a schematic diagram showing an apparatus according to a second embodiment of the present invention.
Figure 6:
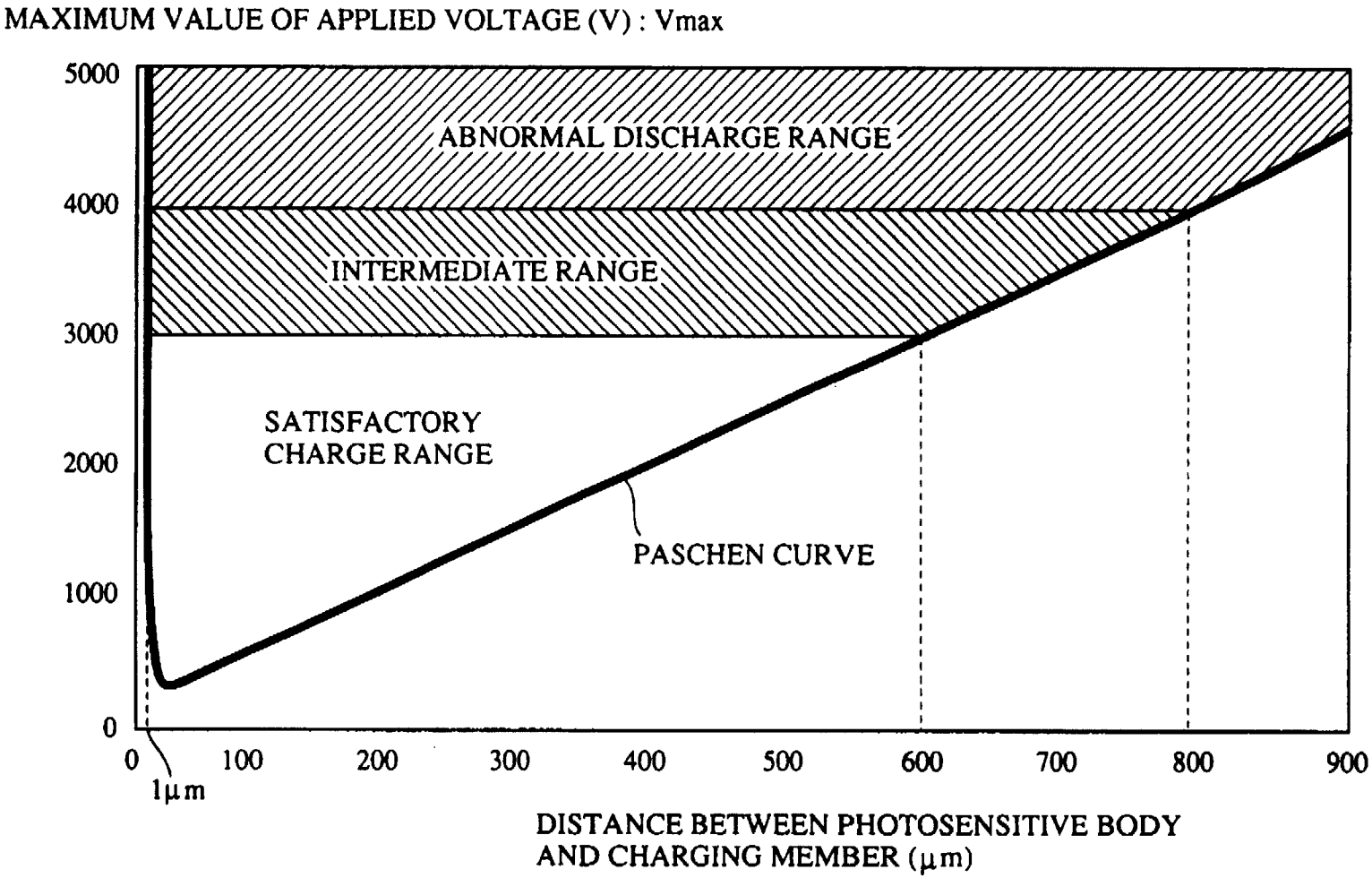
FIG. 6 is a diagram showing the relationship between the distance between a charging member and a photosensitive drum and the maximum voltage Vmax needed for attaining the requisite discharge for charging process.

Second Embodiment (FIGS. 5 and 6)

In this embodiment, the charging member 210 is arranged in such a way that the distance between it and the photosensitive drum 100 is 200 μm on the upstream side, and 750 μm on the downstream side, with respect to the direction of rotation A of the photosensitive drum 100. Otherwise, the construction of this embodiment is the same as that of the first embodiment, so a description of its construction will be omitted.

In the charging member 210 having a concave charging surface, an abnormal image may, in some rare cases, be generated when a voltage of 4 kV or more is applied as the maximum value Vmax of the application voltage (DC component Vdc+½ ×AC component Vac).

In view of this, it is desirable that the application voltage Vmax be not larger than 4 kV. For this purpose, the charging surface of the charging member 210 is situated at a position where discharge can be effected with an application voltage lower than the above-mentioned value, that is, at a position spaced apart from the photosensitive drum surface by a distance not less than 1 μm but not more than 800 μm (In FIG. 5, r−R+=800 μm), as indicated by FIG. 6, which shows the relationship between the distance between the charging member and the photosensitive drum surface and the maximum value Vmax of the requisite voltage for effecting the discharge needed for the charging process.

In this embodiment, the charging member 210 is arranged at such a position, and a DC voltage component Vdc of −700 V and an AC voltage component Vac of 2.5 Vpp are applied, thereby making it possible to perform a satisfactory charging process.

Thus, in a charging device in which at least a part of the charging surface is formed as a concave surface and in which the gap between the object to be charged and the charging member is relatively wider on the downstream side than on the upstream side with respect to the direction of movement of the object to be charged, and the charging surface of the charging member is arranged at a position spaced apart from the surface of the object to be charged by a distance that is not smaller than 1 μm but not larger than 800 μm, it is possible to reduce the interference pattern and the charging noise to a negligible level and to eliminate abnormal image due to excessive discharge.

While in this embodiment the charging surface of the charging member is positioned in the range of not less than 1 μm and but not more than 800 μm from the surface of the photosensitive drum in view of the fact that over discharge occurs at an application voltage Vmax of 4 kV or more, an application voltage of 3 kV or less is desirable for still more satisfactory charging, as shown in FIG. 6, taking environmental fluctuations into account.

Thus, it is desirable for the charging surface of the charging member to be arranged at a position spaced apart from the photosensitive drum surface by a distance which is not less than 1 μm but not more than 600 μm.

Further, it is not necessary for the charging surface of the charging member to be entirely positioned within the above range (i.e., not less than 1 μm but not more than 800 μm from the surface of the photosensitive drum). Charging can be effected to a sufficient degree if only a part of the charging surface is within the above region.

Figure 7:
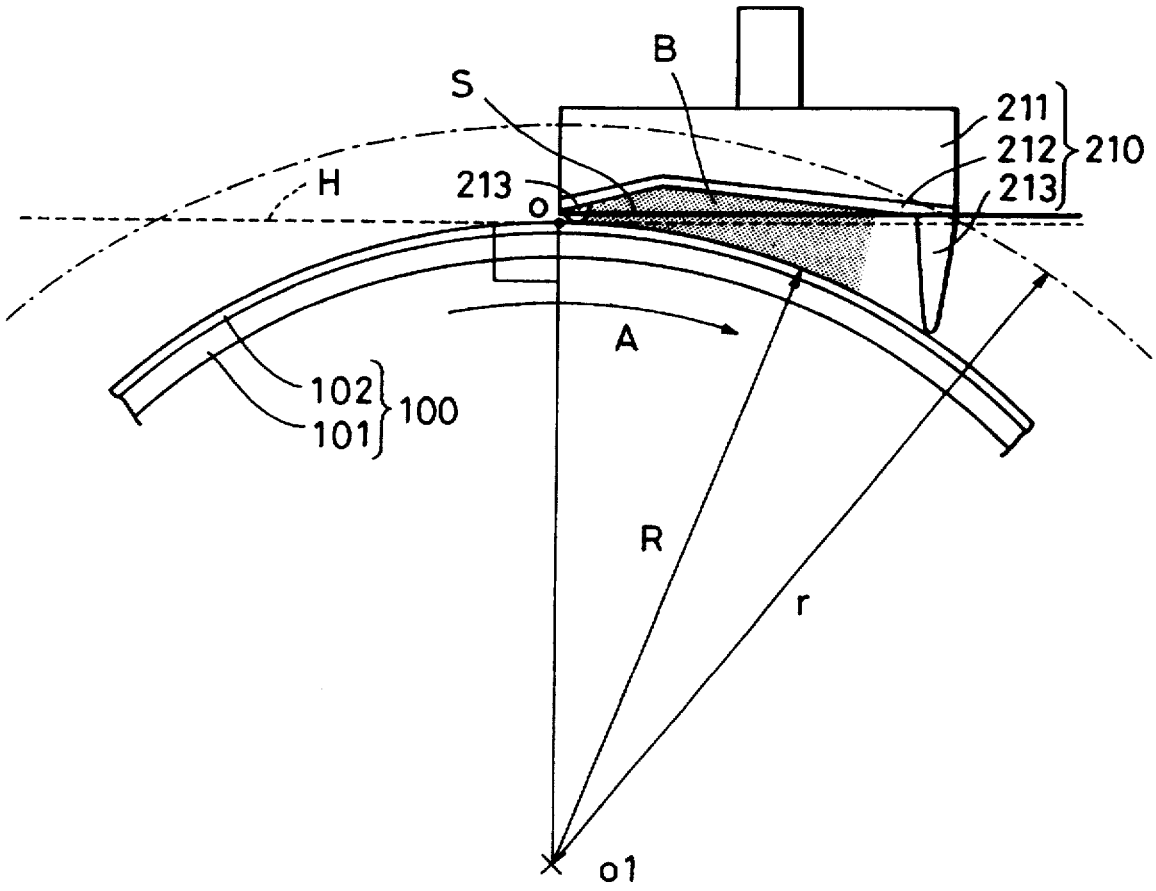
FIG. 7 is a schematic diagram showing an apparatus according to a third embodiment of the present invention.
Figure 8:
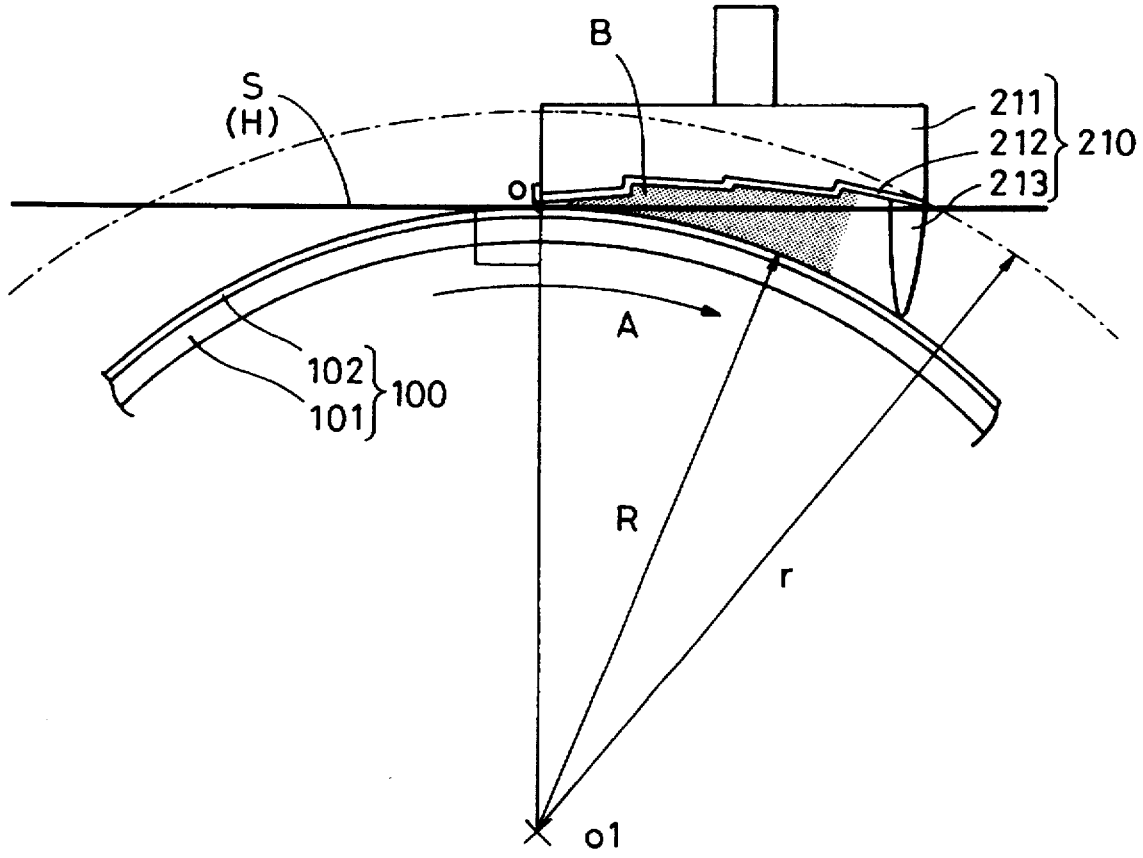
FIG. 8 is a schematic diagram showing an apparatus having a different construction.

Third Embodiment (FIGS. 7 and 8)

In this embodiment, the charging surface of the charging member, formed as a concave surface, is not a cylindrical surface having a fixed curvature as in the first embodiment (FIGS. 1 and 2). Otherwise, this embodiment is the same as the first one. With a charging device whose charging member 210 had such a configuration, the same effect as that of the first embodiment could be obtained.

Thus, it is not absolutely necessary for the charging surface of the charging member to be a smooth concave surface.

Further, as shown in FIG. 8, a plurality of concave surface sections may be provided. Further, it is also possible to hold the charging member in contact with the drum and to provide a high-resistance layer, etc. in the contact section, holding the upstream side section to be in a contact state.

Figure 9:
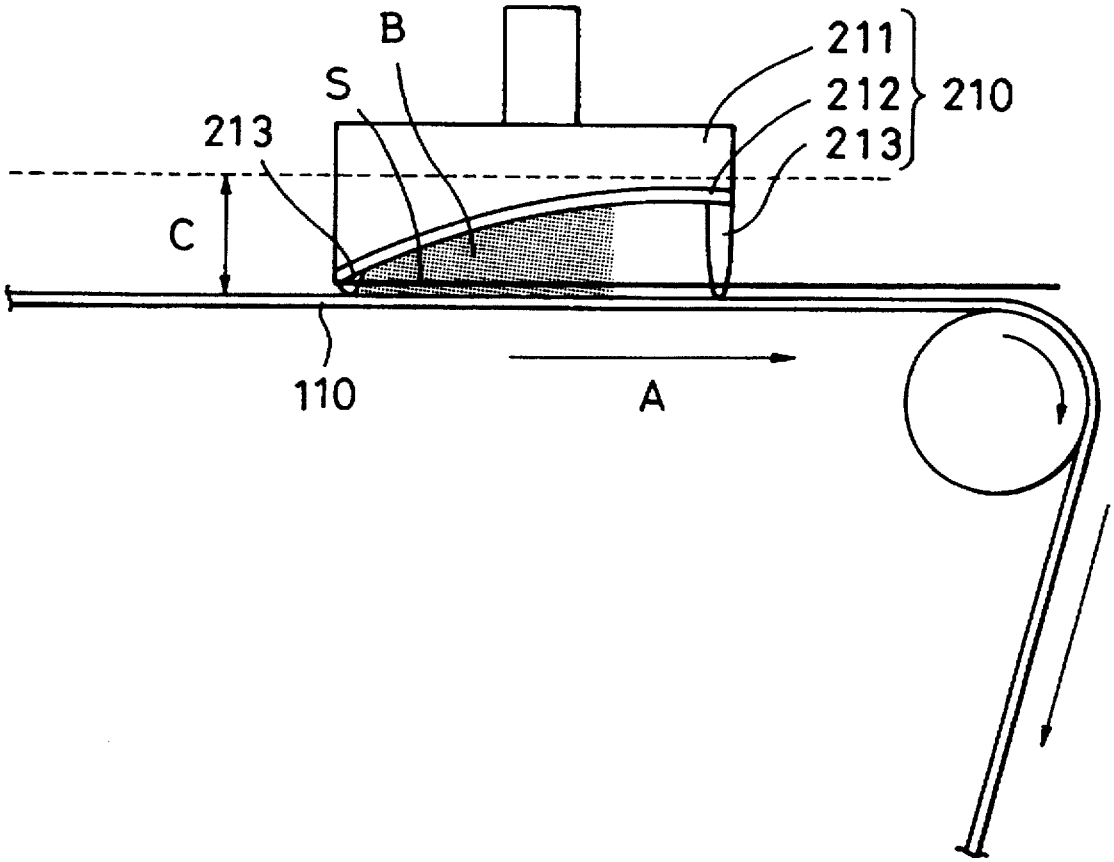
FIG. 9 is a schematic diagram showing an apparatus according to a fourth embodiment of the present invention.

Fourth Embodiment (FIG. 9)

In this embodiment, the charging device of the first embodiment is used as the charging means for an image forming apparatus using a belt-like photosensitive member 110. Thus, even when the object to be charged is not formed as a drum-shaped member, the same effect as those of the first and second embodiments can be obtained by forming at least a part of the charging surface of the charging member as a concave surface, holding the charging member in such a way that the gap between it and the object to be charged is wider on the downstream side than on the upstream side with respect to the direction of movement of the object to be charged, and arranging at least a part of the charging surface of the charging member within the region where charging is possible even with an application voltage which will not cause excessive discharge (a region from not less than 1 μm but not more than 800 μm from the surface of the photosensitive member; the dimension indicated at C in the FIG. 9, which is 800 μm).

Thus, the present invention is not restricted to a particular configuration of the charging member, but allows relatively flexible adaptation to different configurations of the charging member.

Figure 10:
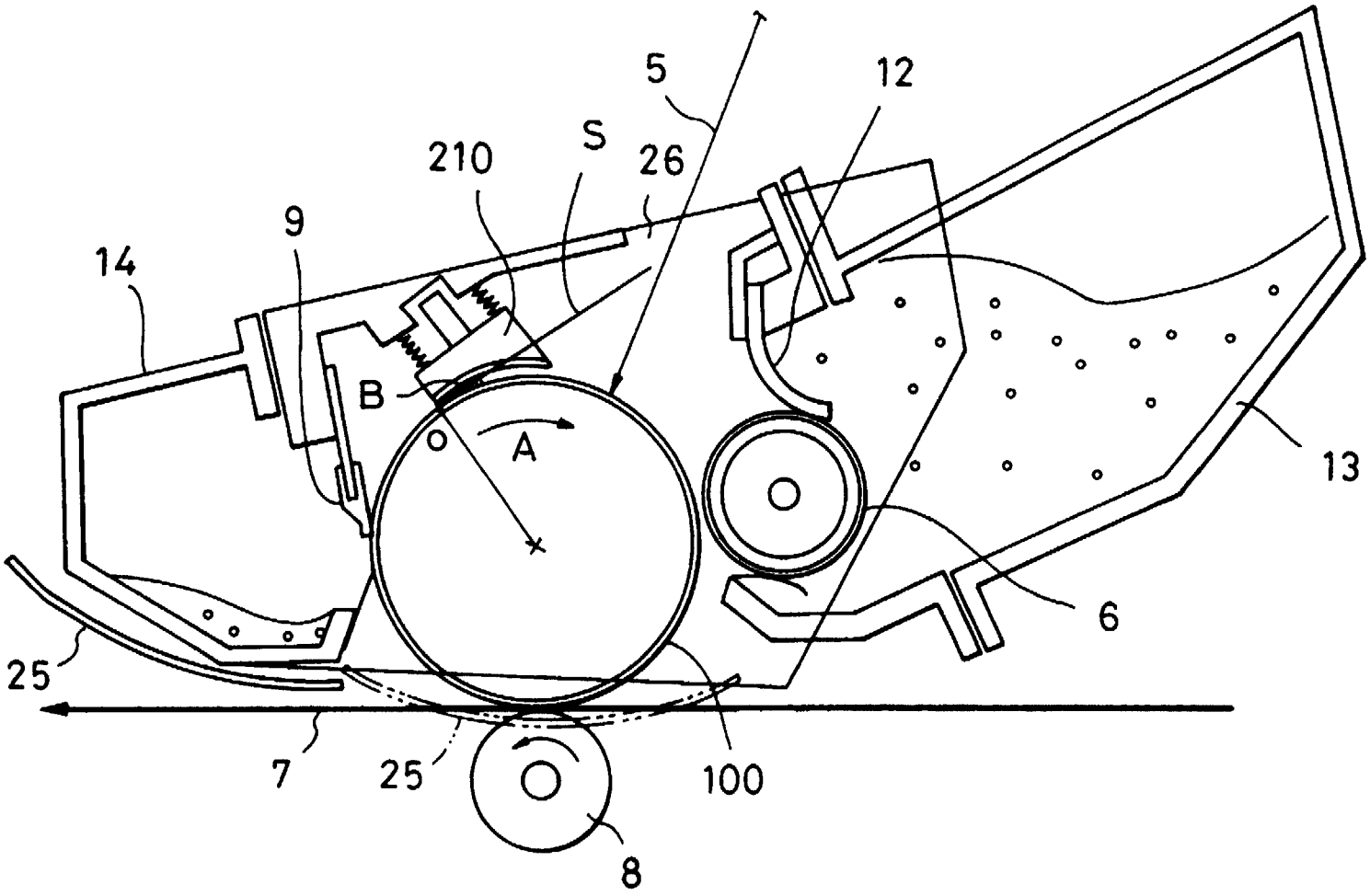
FIG. 10 is a schematic diagram showing a process cartridge.
Figure 11:
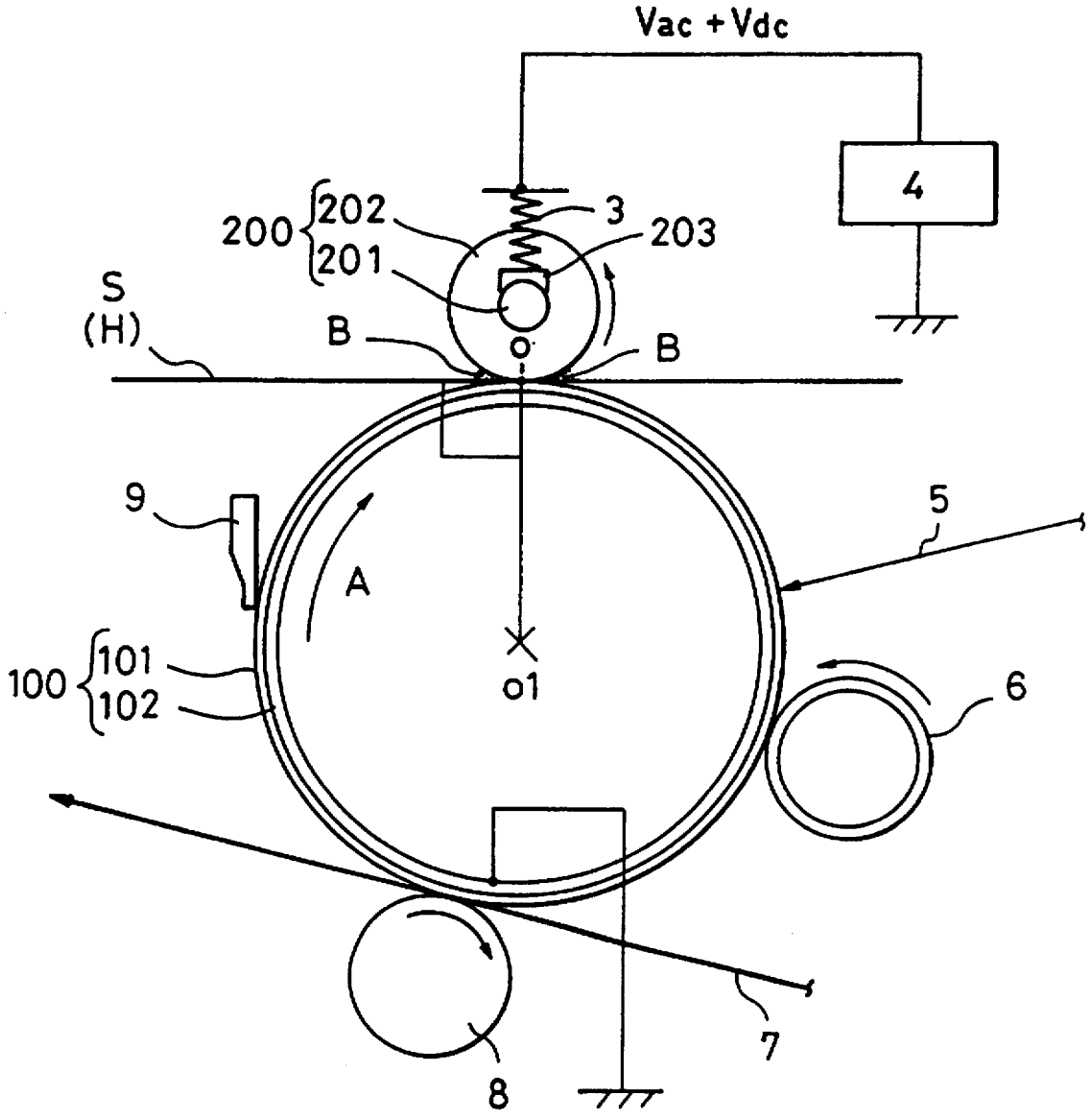
FIG. 11 PRIOR ART
FIG. 11 is a schematic diagram showing a conventional apparatus.

FIG. 10 shows an embodiment in which a charging device as described above is incorporated into a process cartridge which is detachably mounted in an image forming apparatus.

This embodiment consists of a process cartridge for an image forming apparatus using a contact-type charging device as the means for charging the object to be charged (the image carrying member).

The process cartridge of this embodiment includes an electrophotographic photosensitive member 100 in the form of a rotating drum serving as the image carrying member, a charging member 210, a developer unit 13, and a cleaner unit 14. The charging member 210 has the same construction as that of the first embodiment.

In the developer unit 13, numeral 6 indicates a development sleeve, and numeral 12 indicates a development blade for coating the development sleeve 6 with toner T in a uniform thickness. In the cleaner unit 14, numeral 9 indicates a cleaning blade.

Numeral 25 indicates a drum shutter of the process cartridge. The drum shutter 25 can be brought to an open state indicated by the solid line and to a closed state indicated by the two-dot chain line. When the process cartridge is outside the body of the image forming apparatus (not shown), the drum shutter 25 is in the closed state indicated by the two-dot chain line and covers the exposed section of the photosensitive drum 100 to protect the photosensitive drum surface.

When the process cartridge is mounted in the body of the image forming apparatus, the shutter 25 is manually brought to the open state indicated by the solid line or automatically opened during the mounting of the process cartridge so as to allow the process cartridge to be mounted in the normal manner, thereby bringing the exposed surface of the photosensitive drum 100 into press contact with the transfer roller 8 in the body of the image forming apparatus.

When the process cartridge is mounted in a predetermined position in the apparatus, the contact point of the process cartridge and the contact point of the body of the image forming apparatus are coupled with each other both mechanically and electrically, whereby the photosensitive drum 100, the development sleeve 6, etc. of the process cartridge can be driven by a driving mechanism in the body of the image forming apparatus. Further, an electric circuit in the body of the image forming apparatus enables a development bias voltage to be applied to the charging member 210 on the process-cartridge side. Thus, the image forming apparatus is made ready for image formation.

Numeral 26 indicates a window for exposure, through which an output laser beam 5 from a laser scanner (not shown) provided on the image forming apparatus body side enters the process cartridge to perform scanning exposure on the surface of the photosensitive drum 100.

Due to this construction, the inter-peak voltage of the periodic fluctuations is very small, so that it is possible to provide a process cartridge which makes it possible to obtain a printed image in which any interference pattern is substantially unnoticeable. Further, the process cartridge of the present invention can be realized in a small and simple structure which is relatively inexpensive.

Here, the term "line scanning" is not restricted to the application of a laser beam along the longitudinal (generatrix) dimension of the image carrying member through the rotation of a polygon mirror. The term also includes a line recording in which LED heads having LED elements, arranged along the longitudinal dimension of the image carrier, are arranged opposite to each other, and a lamp is turned ON/OFF in accordance a signal from a controller, thereby effecting line recording.

Further, the image carrying member is not restricted to a photosensitive drum. An insulating image carrying member is also applicable. In this case, multi-stylus recording heads, having pin-shaped electrodes arranged opposite to each other along the longitudinal dimension of the image carrying member, are arranged opposite to each other on the downstream side of the charging member with respect to the direction of movement of the image carrying member, and a latent image is formed after charging. Further, the image forming apparatus of the present invention is applicable to both normal and reversal development.

As described above, in accordance with the present invention, in a contact charging member, or in a charging device, an image forming apparatus or a process cartridge having such a contact charging member, it is possible to mitigate the periodic fluctuations in surface potential of the object to be charged, whereby it is possible to reduce the interference pattern to a negligible level. Further, it is possible to perform stable charging without generating any abnormal image due excessive charge.

Further, the fact that the periodic fluctuations in surface potential can be mitigated means, at the same time, that the application frequency can be reduced while maintaining the same process speed. As a result, it is also possible to reduce the charging noise.

It is to be understood that the present invention is not restricted to the above-described embodiments. All modifications are possible within the scope of the invention.

What is claimed is:

1. A charging device for charging an object to be charged, said charging device comprising:

a non-rotatable charging member having a section positioned in contact with or in close proximity to the object to be charged for the purpose of charging the object, said charging member having a concave charging surface located downstream from a downstream end point on the object to be charged that corresponds to the contact section or the closest-proximity section between said charging member and the object to be charged, the concave charging surface being positioned in its entirety on a side of a line H that is opposite from a side at which the object to be charged is disposed in its entirety, wherein line H is a line that (i) is tangent to a surface of the object to be charged at a point at the downstream end point of the contact section or the closest-proximity section between said charging member and the object to be charged, (ii) is parallel to the direction of movement of the surface of the object to be charged at the end point, and (iii) extends downstream from the point of tangency, where the downstream direction is determined with respect to the direction of movement of the object to be charged.

2. A charging device according to claim 1, wherein, in a charging region for said object to be charged, when a gap exists between said object to be charged and said charging member, the gap is wider on the downstream side than on the upstream side with respect to the direction of movement of said object to be charged.

3. A charging device according to claim 1, wherein when a gap exists between said object to be charged and said charging member, the shortest distance between each point on said charging surface and the surface of said object to be charged is not less than 1 μm but not more than 800 μm.

4. A charging device according to claim 1, further comprising means for applying a voltage between said charging member and said object to be charged.

5. A charging device according to claim 4, wherein said voltage is an oscillating voltage.

6. A charging device according to claim 5, wherein said oscillating voltage is a voltage which is composed of AC and DC voltages superimposed one upon the other.

7. A charging device according to claim 5 or 6, wherein said oscillating voltage has an inter-peak voltage which is not less than double a charging start voltage which is a DC voltage that is applied between said charging member and said object to be charged to start the charging of said object to be charged.

8. A charging device according to claim 4, wherein said voltage is a DC voltage.

9. A process cartridge which is detachably mounted in an image forming apparatus, said process cartridge comprising:

an object to be charged which is capable of carrying images; and a non-rotatable charging member held in contact with or in close proximity to said object to be charged for the purpose of charging the object, said charging member having a concave charging surface located downstream from a downstream end point on the object to be charged that corresponds to the contact section or the closest-proximity section between said charging member and the object to be charged being positioned in its entirety on a side of a line H that is opposite from a side at which said object to be charged is disposed, wherein line H is a line that (i) is tangent to a surface of said object to be charged at a point at the downstream end point of the contact section or the closest-proximity section between said charging surface and said object to be charged, (ii) is parallel to the direction of movement of the surface of the object to be charged at the end point, and (iii) extends downstream from the point of tangency, where the downstream direction is determined with respect to the direction of movement of said object to be charged.

10. A process cartridge according to claim 9, further comprising a developer unit for performing development on said object to be charged by using toner.

11. A process cartridge according to claim 9, wherein, when said process cartridge is mounted in the image forming apparatus, an oscillating voltage can be applied between said object to be charged and said charging member.

12. An image forming apparatus comprising:

an object to be charged on which images can be formed;

image forming means for forming images on the object to be charged; and a non-rotatable charging member having a section positioned in contact with or in close proximity to said object to be charged for the purpose of charging said object, said charging member having a concave charging surface located downstream from a downstream end point on the object to be charged that corresponds to the contact section or the closest-proximity section between said charging member and the object to be charged being positioned in its entirety on a side of a line H that is opposite from a side at which said object to be charged is disposed, wherein line H is a line that (i) is tangent to a surface of said object to be charged at a point at the downstream end point of the contact section or the closest-proximity section between said charging surface and said object to be charged, (ii) is parallel to the direction of movement of the surface of the object to be charged at the end point, and (iii) extends downstream from the point of tangency, where the downstream direction is determined with respect to the direction of movement of said object to be charged.

13. An image forming apparatus according to claim 12, further comprising means for applying an oscillating voltage between said charging member to said object to be charged.

14. An image forming apparatus according to claim 13, further comprising a means for forming images by performing line scanning on said object to be charged.

* * * * *

UNITED STATES PATENT AND TRADEMARK OFFICE

CERTIFICATE OF CORRECTION

PATENT NO. : 5,546,167

DATED : August 13, 1996

INVENTOR(S) : HIROAKI OGATA, ET AL.

It is certified that error appears in the above-indentified patent and that said Letters Patent is hereby corrected as shown below:

COLUMN 3:

Line 37, delete "in".

COLUMN 5:

Line 10, change "Shown)" to --shown)--; and
Line 29, change "5The" to --¶ The--.

COLUMN 7:

Line 11, change "moir" to --moiré,--;
Line 12, delete "é,"; and
Line 45, change "r-R+=800 μm)," to --r-R=800 μm),--.

Signed and Sealed this

Twenty-first Day of January, 1997

*Attest:*

*Attesting Officer*

BRUCE LEHMAN

*Commissioner of Patents and Trademarks*